United States Patent [19]

Sherman

[11] 4,096,027

[45] Jun. 20, 1978

[54] SYSTEM FOR PRESTEAMING WOOD CHIPS AT OR NEAR ATMOSPHERIC PRESSURE WITH MINIMUM DISPLACEMENT OF AIR

[75] Inventor: Michael I. Sherman, Glens Falls, N.Y.

[73] Assignee: Kamyr Inc., Glens Falls, N.Y.

[21] Appl. No.: 659,402

[22] Filed: Feb. 19, 1976

[51] Int. Cl.[2] ..... D21C 1/02; D21C 3/24; D21C 7/06; D21C 7/12

[52] U.S. Cl. ..... 162/18; 162/19; 162/61; 162/68; 162/237; 162/238; 162/246

[58] Field of Search ..... 162/17, 18, 19, 15, 162/49, 51, 52, 61, 68, 237, 238, 242, 246; 98/115 R

[56] References Cited

U.S. PATENT DOCUMENTS

| | | | |
|---|---|---|---|
| 2,858,211 | 10/1958 | Durant et al. | 162/19 X |
| 2,905,240 | 9/1959 | Sandberg | 162/18 X |
| 3,471,365 | 10/1969 | Asplund | 162/237 |
| 3,532,594 | 10/1970 | Richter | 162/19 |
| 3,578,554 | 5/1971 | Richter | 162/19 |
| 3,814,664 | 6/1974 | Carlsmith | 162/237 X |

*Primary Examiner*—Richard V. Fisher
*Attorney, Agent, or Firm*—Cushman, Darby & Cushman

[57] ABSTRACT

A method and apparatus for presteaming of wood chips and the like. The chips are treated in a vertical presteaming vessel with steam under low pressure, and removal of the air from the chips is facilitated by maintaining the presteaming vessel substantially at or near atmospheric pressure. An exhaust fan, controlled by a pressure probe in the presteaming vessel, may be provided for maintaining the pressure in the vessel. The amount of air that can enter the vessel through the chips inlet is minimized by an inclined rotating screw assembly with a partial flight which elevates the packs and chips to form an isolation seal at the chips inlet into the vessel.

8 Claims, 1 Drawing Figure

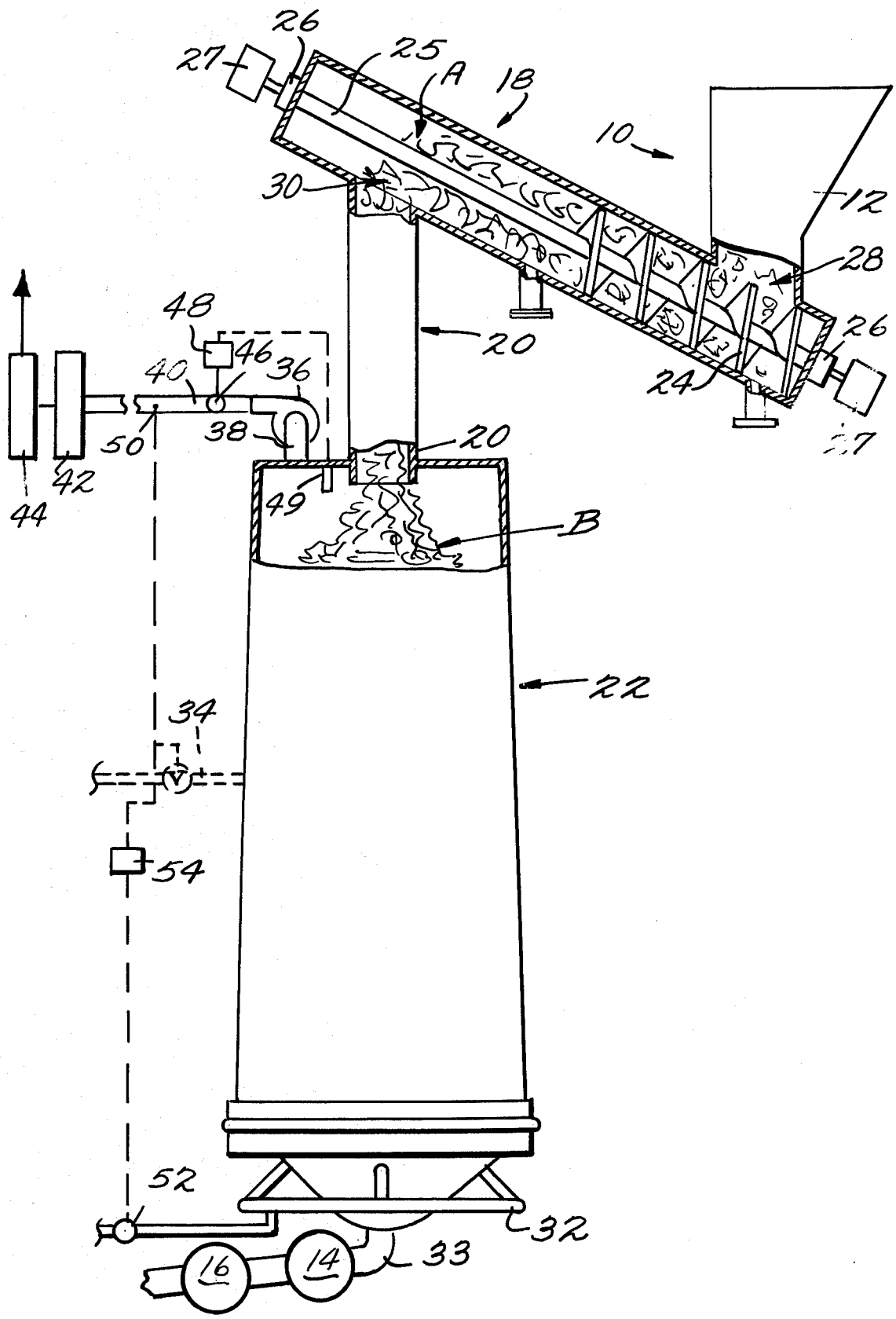
26
27
25
A
18
10
12
30
28
26
24
27
48
46
40
36
38
50
42
44
20
20
49
B
22
34
54
52
32
33
16
14

SYSTEM FOR PRESTEAMING WOOD CHIPS AT OR NEAR ATMOSPHERIC PRESSURE WITH MINIMUM DISPLACEMENT OF AIR

BACKGROUND AND SUMMARY OF THE INVENTION

The invention relates to a system for presteaming wood chips or the like. In the past, two different general types of presteaming vessels have been utilized in the pulp processing field, a horizontal screw-conveyor type of presteaming vessel for treatment over about 212° F — such as shown in U.S. Pat. No. 3,298,899 — and vertical presteaming vessels — one type of which is shown in U.S. Pat. Nos. 3,532,594 and 3,578,554. The general purpose of presteaming utilizing either type of conventional presteamer is to remove air from the chips to be treated, and to preheat them. Presteaming is important in the conservation of energy in the pulp processing system and in preparing the chips for absorption of the cooking chemicals.

According to the present invention, the removal of air from wood chips and the like during preheating is facilitated by maintaining the chips at about atmospheric pressure, or slightly below atmosphere pressure, during presteaming. Under these circumstances the provision of air pollution equipment is necessary, however, since some air must constantly be withdrawn from the presteaming vessel in order to hold it at or slightly below atmospheric pressure. This is in contradistinction to the prior art patents mentioned above wherein the gases from the presteaming chamber are only periodically vented when the pressure builds up to too high a level (see valve 21 in U.S. Pat. No. 3,298,899, valve 12 in U.S. Pat. No. 3,532,594 and line 39 in U.S. Pat. No. 3,578,554). Economical operation of a vertical presteamer at or slightly below atmospheric pressure, because of the necessary air pollution equipment, depends upon not drawing too large an amount of gas through the presteaming vessel for treatment, since the cost and efficiency of the system is greatly dependent upon the amount of air treated.

According to the present invention, chips have the air removed therefrom in a presteaming vessel at or slightly below atmospheric pressure with a minimum amount of air removal from the presteamer itself. The top of the vertical presteaming vessel according to the present invention is closed and has a fan in operative communication therewith. The fan essentially continuously operates and removes gas from the vessel and transports it to a condenser and further air pollution control equipment. The chips are fed into the vessel by a rotating inclined screw with a partial flight. The flight pushes a plug of chips into the vessel, the chip plug providing an effective air lock, and preventing the movement of too large a volume of air through the chips under the suction of the fan. Since the air lock is provided by the chips and the like themselves, and there are no closely rotating metal or other material parts to form the isolation seal, the wear on the feeder is minimal. A temperature control is provided in the exhaust from the fan to control the amount of low pressure steam that is introduced into the presteaming vessel (the invention is useful for treatment at about 180°–190° F), and a pressure control is provided between the fan (or a valve associated therewith) and the interior of the presteaming vessel to control the amount of gas exhausted from the presteaming vessel to keep the vessel at the desired pressure at or slightly below atmospheric.

It is the primary object of the present invention to provide for improved pretreatment of wood chips in a vertical presteaming vessel. This and other objects of the invention will become clear from an inspection of the detailed description of the invention, and from the appended claims.

BRIEF DESCRIPTION OF THE DRAWINGS

The drawing is a diagrammatic view, partly in section and partly in elevation, of an exemplary apparatus that may be utilized according to the present invention for the presteaming of wood chips or the like.

DETAILED DESCRIPTION OF THE INVENTION

An exemplary assembly according to the present invention is shown generally at 10 in the drawing. The assembly includes a chips bin 12, for wood chips, sawdust, and other digestible product such as shavings, bagasse, annual plants, etc., hereinafter referred to as wood chips and the like, an inclined rotating screw assembly 18, and an inlet 20 for a conventional sealed presteaming vessel 22 or the like. [Alternatively, the vessel 22 could lead to another, higher pressure presteaming vessel]. The inclined rotating screw assembly 18 includes a partial flight conveyor 24 that is rotatable about shaft 25, the shaft 25 attached to the housing for the assembly with pillow block bearings having stuffing boxes 26 associated therewith (such as the stuffing boxes illustrated in U.S. Pat. No. 3,191,540, the disclosure of which is hereby incorporated by reference in the present application). The shaft 25 is rotated by any suitable power means 27. Screw assembly 18 has an inlet 28 thereof operatively connected to chips bin 12 at a first level, and has an outlet 30 thereof (connected to chips inlet 20 for the presteaming vessel 22) at a second level generally vertically above the level of inlet 28. Chips entering assembly 18 at inlet 28 are elevated and packed by the partial flight 24 (the flight 24 terminating before the outlet 30) so that an isolation seal is provided by the plug A formed by the packing and elevation of the chips and the like by assembly 18. Plug A minimizes the amount of air flowing into the chips inlet 20 to the presteaming vessel 22 and does so without close-fitting interengagement of metal parts and the like—thus there will be very little deterioration in the effectiveness of the air lock provided at inlet 20 over time.

The vertical presteaming vessel 22 may be a vessel exclusively for presteaming, having pipes 32 or like means for introducing steam under low pressure at the bottom thereof, or it can be a vessel having a presteaming area near the top thereof, and an area for impregnation of the chips with digesting liquor at the lower portion thereof. In the latter case, the vessel 22 would assume the general form of the vessel 37 shown in U.S. Pat. No. 3,578,554, the disclosure of which is hereby incorporated by reference in the present application. In such a case, steam under low pressure could be introduced through pipes 34 or the like (shown in dotted line at a middle portion of vessel 22 in the drawing). The chips form a generally columnar arrangement B when in the vessel 22, and after presteaming thereof to remove all the air from the chips and to preheat them, they are expelled from the vessel 22 through chips outlet 33. From outlet 33 the chips go on to a conventional digestor or like treatment station. A conventional chips meter 14 and low pressure chips feeder valve 16 may be provided in outlet 33, if desired.

The pressure in the vessel 22 is maintained substantially at or slightly below atmospheric pressure in order to facilitate the removal of the air from the chips, which is a primary function of presteaming. Maintenance of this pressure can be accomplished by an exhaust fan 36 or the like operatively connected to a top portion of the vessel 22 through pipe 38; the formation of the isolation seal by chips plug A will ensure that too much air is not exhausted by the fan 36 so as to make treatment thereof for removal of air pollutants uneconomical and inefficient. The exhaust pipe 40 from exhaust fan 36 or the like is operatively connected to a condenser 42, which is in turn connected to further suitable treatment equipment 44 for the removal of air polluntants, and then the treated gases may be discharged into the atmosphere with minimum adverse environmental impact.

The amount of gas that is exhausted by the fan 36 or the like is controlled by the pressure within the vessel 22, which pressure is sensed by a probe 49 or the like, which is connected via a control 48 to a valve 46 in the fan exhaust line 40. In this way the fan 36 substantially continuously operates while the amount of gas that it exhausts is controlled by controlling the opening of the valve 46. Of course the probe 49 can control the speed of operation of the fan 36 instead (or in addition to) controlling the valve 46 if desired.

According to another advantageous feature of the present invention, the amount of steam used is properly controlled so that wastage is minimized, and the temperature within the vessel 22 is maintained at approximately 180°–190° F, which has been found suitable for the particular presteaming method according to the present invention. A temperature sensitive probe 50 is disposed in the exhaust line 40 of fan 36 or the like, which probe is operatively connected through temperature indicator and control 54 to a valve 52 for controlling the amount of steam being introduced into the vessel 22 through pipes 32. Only as much steam is introduced as is necessary to effectively treat the chips column B in the vessel 22.

The operation of the exemplary apparatus 10 according to the present invention is as follows: Chips are fed from bin 12 to inlet 28 for inclined rotating partial flight screw assembly 18. The chips are elevated and packed by assembly 18, a chips plug A being formed adjacent outlet 30 for assembly 18 (and adjacent inlet 20 for vertical presteaming vessel 22) so that an isolation seal is formed, preventing the entry of air into the presteaming vessel 22 through inlet 20. Steam under low pressure is introduced into vessel 22 through inlets 32, and the chips are heated (to about 180°–190° F), and the air removed therefrom. The removal of the air from the chips is facilitated by the maintenance of the pressure in vessel 22 at or slightly below atmospheric pressure, this pressure being maintained by exhausting the gas from the vessel 22 by fan 36. The amount of gas that is exhausted from vessel 22 is controlled by pressure sensitive probe 49 and pressure control 48. The exhausted gas is treated by condenser 42 and other equipment 44, and then is expelled to the atmosphere. The chips are expelled from vessel 22 through outlet 33, and then are further treated, as in a conventional digestor. The amount of steam used is minimized by use of temperature probe 50 and temperature control 54 which controls the amount of steam being introduced into vessel 22.

It will thus be seen that according to the present invention an exemplary improved assembly has been disclosed for presteaming of wood chips, as well as an improved method, the method comprising the steps of introducing wood chips and the like into a vertical presteaming vessel while providing an isolation seal at the chips entrance to minimize the amount of air that will flow into the presteaming vessel through the chips inlet, introducing steam under low pressure into the presteaming vessel, maintaining the presteaming vessel substantially at or slightly below atmospheric pressure, and expelling presteamed wood chips and the like from the presteaming vessel chips outlet.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method for presteaming wood chips and the like in a sealed vertical presteaming vessel having a chips inlet in a top portion thereof, and a chips outlet at a bottom portion thereof prior to digestion, comprising the steps of introducing steam under low pressure into said presteaming vessel, introducing wood chips and the like into said wood chips inlet of said presteaming vessel while providing an isolation seal in the area of introduction to minimize the amount of air that will flow into said presteaming vessel through said chips inlet thereof, maintaining said presteaming vessel substantially at or slightly below atmospheric pressure, expelling presteamed wood chips and the like from said presteaming vessel chips outlet, and sensing the temperature of gases exhausted from said presteaming vessel and controlling the rate of steam introduction based on the temperature of the gases exhausted from said presteaming vessel.

2. A method for presteaming wood chips and the like in a sealed vertical presteaming vessel having a chips inlet in a top portion thereof, and a chips outlet at a bottom portion thereof prior to digestion, comprising the steps of introducing steam under low pressure into said presteaming vessel, introducing wood chips and the like into said wood chips inlet of said presteaming vessel while providing an isolation seal in the area of introduction to minimize the amount of air that will flow into said presteaming vessel through said chips inlet thereof, said step of introducing being accomplished by packing and elevating said wood chips and the like, forming an isolation seal with the wood chips during the packing and elevating thereof to prevent entry of air into said presteaming vessel, maintaining said presteaming vessel substantially at or slightly below atmospheric pressure, expelling presteamed wood chips and the like from said presteaming vessel chips outlet, and sensing the temperature of gases exhausted from said presteaming vessel and controlling the rate of steam introduction based on the temperature of the gases exhausted from said presteaming vessel.

3. A method for presteaming wood chips and the like in a sealed vertical presteaming vessel having a chips inlet in a top portion thereof, and a chips outlet at a bottom portion thereof prior to digestion, comprising the steps of introducing steam under low pressure into said presteaming vessel, introducing wood chips and the like into said wood chips inlet of said presteaming vessel while providing an isolation seal in the area of introduction to minimize the amount of air that will flow into said presteaming vessel through said chips inlet thereof, said step of introducing being accomplished by packing and elevating said wood chips and the like, forming an isolation seal with the wood chips during the packing and elevating thereof to prevent entry of air into said presteaming vessel, maintaining said presteaming vessel substantially at or slightly below atmospheric pressure, by substantially continuously exhausting gases from a top portion of said presteaming vessel at a rate dependent upon the pressure existing in said presteaming vessel, expelling presteamed wood chips and the like from said presteaming vessel chips outlet, and sensing the temperature of gases exhausted from said presteaming vessel and controlling the rate of steam introduction based on the temperature of the gases exhausted from said presteaming vessel.

4. A method as recited in claim 3 comprising the further step of impregnating said wood chips and the like with digesting liquor in a lower portion of said presteaming vessel.

5. An assembly for presteaming wood chips and the like prior to digestion, said assembly comprising:

a sealed vertical presteaming vessel having an inlet for wood chips and the like at a top portion thereof, and an outlet in a bottom portion thereof, means for introducing steam under low pressure into said vertical presteaming vessel, means for introducing wood chips and the like into said wood chips inlet of said presteaming vessel and for providing an isolation seal thereat so that a minimum amount of air will flow into said presteaming vessel through said chips inlet thereof, and means for maintaining said presteaming vessel substantially at or slightly below atmospheric pressure, said means including an exhaust fan operatively connected to the interior of said presteaming vessel adjacent a top portion thereof, and a pressure probe extending into said presteaming vessel and operatively connected to means for controlling the amount of gas exhausted by said exhaust fan.

6. An assembly for presteaming wood chips and the like prior to digestion, said assembly comprising:

a sealed vertical presteaming vessel having an inlet for wood chips and the like at a top portion thereof, and an outlet in a bottom portion thereof, means for introducing steam under low pressure into said vertical presteaming vessel, means for introducing wood chips and the like into said wood chips inlet of said presteaming vessel and for providing an isolation seal thereat so that a minimum amount of air will flow into said presteaming vessel through said chips inlet thereof, said means comprising a rotating inclined screw assembly, said screw assembly having an inlet at a first level thereof, and an outlet leading into said presteaming vessel chips inlet at a second level thereof vertically above said first level, and a partial flight extending from said screw assembly inlet toward said screw assembly outlet but terminating a substantial distance before said screw assembly outlet so that said inclined screw assembly packs said wood chips and the like transported thereby into a plug as they are elevated thereby, the wood chips plug forming the isolation seal, and means for maintaining said presteaming vessel substantially at or slightly below atmospheric pressure, said means including an exhaust fan operatively connected to the interior of said presteaming vessel adjacent a top portion thereof, and wherein a temperature control is connected to an exhaust line from said exhaust fan and operatively connected to said means for introducing steam under low pressure into said presteaming vessel.

7. An assembly for presteaming wood chips and the like prior to digestion, said assembly comprising:

a sealed vertical presteaming vessel having an inlet for wood chips and the like at a top portion thereof, and an outlet in a bottom portion thereof, means for introducing steam under low pressure into said vertical presteaming vessel, means for introducing wood chips and the like into said wood chips inlet of said presteaming vessel and for providing an isolation seal thereat so that a minimum amount of air will flow into said presteaming vessel through said chips inlet thereof, said means comprising a rotating inclined screw assembly, said screw assembly having an inlet at a first level thereof, and an outlet leading into said presteaming vessel chips inlet at a second level thereof vertically above said first level, and a partial flight extending from said screw assembly inlet toward said screw assembly outlet but terminating a substantial distance before said screw assembly outlet so that said inclined screw assembly packs said wood chips and the like transported thereby into a plug as they are elevated thereby, the wood chips plug forming the isolation seal, and means for maintaining said presteaming vessel substantially at or slightly below atmospheric pressure, said means including an exhaust fan operatively connected to the interior of said presteaming vessel adjacent a top portion thereof, and wherein said presteaming vessel pressure maintaining means further comprises a pressure probe extending into said presteaming vessel and operatively connected to means for controlling the amount of gas exhausted by said exhaust fan.

8. An assembly as recited in claim 7 wherein said presteaming vessel includes a lower portion thereof including means for impregnating wood chips and the like therein with digesting liquor.

* * * * *